United States Patent [19]

Mellinger et al.

[11] Patent Number: 4,734,943

[45] Date of Patent: Apr. 5, 1988

[54] WASTE DISPOSAL SYSTEM

[76] Inventors: Melvyn W. Mellinger, 1050 SE. 15th St., #602, Fort Lauderdale, Fla. 33316; Robin McPhail, 304 SW. 7 St., Fort Lauderdale, Fla. 33315

[21] Appl. No.: 873,186

[22] Filed: Jun. 10, 1986

[51] Int. Cl.[4] ..... E03D 1/00; E03D 3/00; E03D 5/00

[52] U.S. Cl. ..... 4/300; 4/317; 4/319; 4/323

[58] Field of Search ..... 4/300, 317, 319, 318, 4/321, 315, 323

[56] References Cited

U.S. PATENT DOCUMENTS

| | | | |
|---|---|---|---|
| 3,587,116 | 6/1971 | Quase | 4/300 |
| 3,602,922 | 9/1971 | Broughton | 4/300 |
| 3,815,159 | 6/1974 | Delaney et al. | 4/300 |
| 3,975,256 | 8/1976 | Johnson et al. | 4/323 X |
| 4,041,555 | 8/1977 | Cole et al. | 4/300 |
| 4,333,185 | 6/1982 | Heinze et al. | 4/300 |

*Primary Examiner*—Henry K. Artis
*Attorney, Agent, or Firm*—Malin, Haley & McHale

[57] ABSTRACT

A self-contained compact pedestal sized marine head comprised of a conventional marine or household size toilet bowl connected to a base which houses an electric motor drivingly connected to a self priming fluid pump. The pump has a single suction water inlet and a first and a second pump outlet. The first pump discharge outlet is fluidly connected via a first pump discharge conduit to the inside of the bowl to act as a rim feed. The second pump discharge outlet is fluidly connected via a second pump discharge conduit to a bowl discharge conduit which is sealingly connected to an opening in the lowermost portion of the bowl. A small nozzle is disposed coaxially within the pump discharge outlet conduit at the point where the end of said outlet conduit joins in fluid communication with the bowl discharge conduit. In this way, all water passing through said second pump discharge conduit upon flushing passes through said nozzle and becomes accelerated and turbulent, aiding the flow rate from the bowl and tending to break up solid matter therefrom. The combined flow from the second discharge conduit and from the bowl fixture then passes through an inverted U-shaped conduit having a one-way vent means for preventing reverse siphoning, and also having a unique unclogging feature. The electric motor may be driven by electricity from the generator or main batteries of the boat or from an independent supply.

10 Claims, 2 Drawing Sheets

FIG. 1
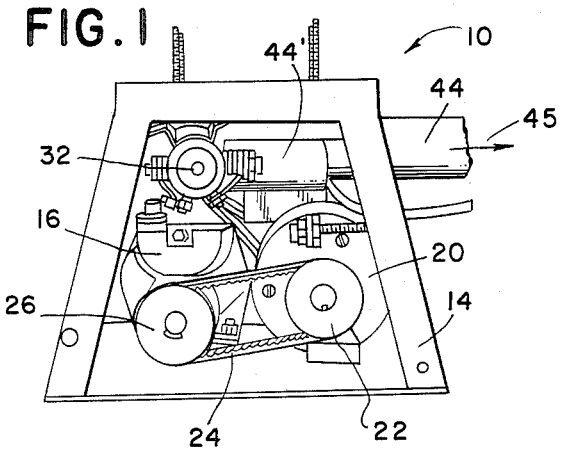
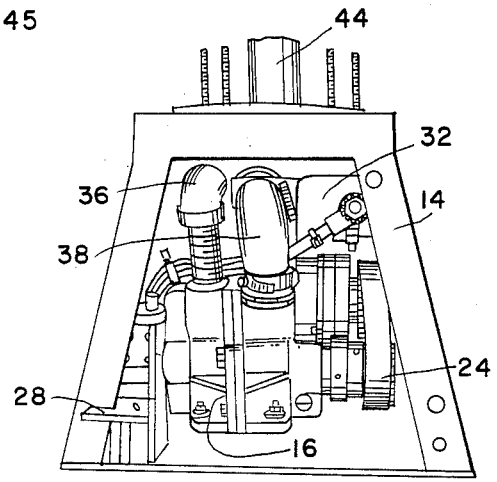
FIG. 2
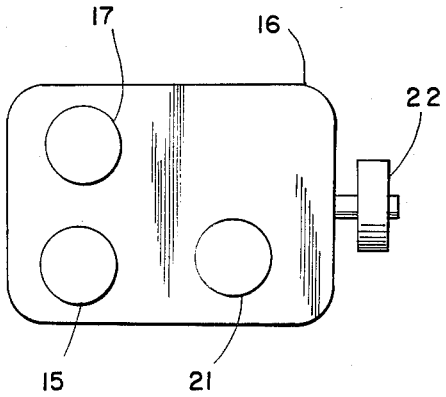
FIG. 7
FIG. 8
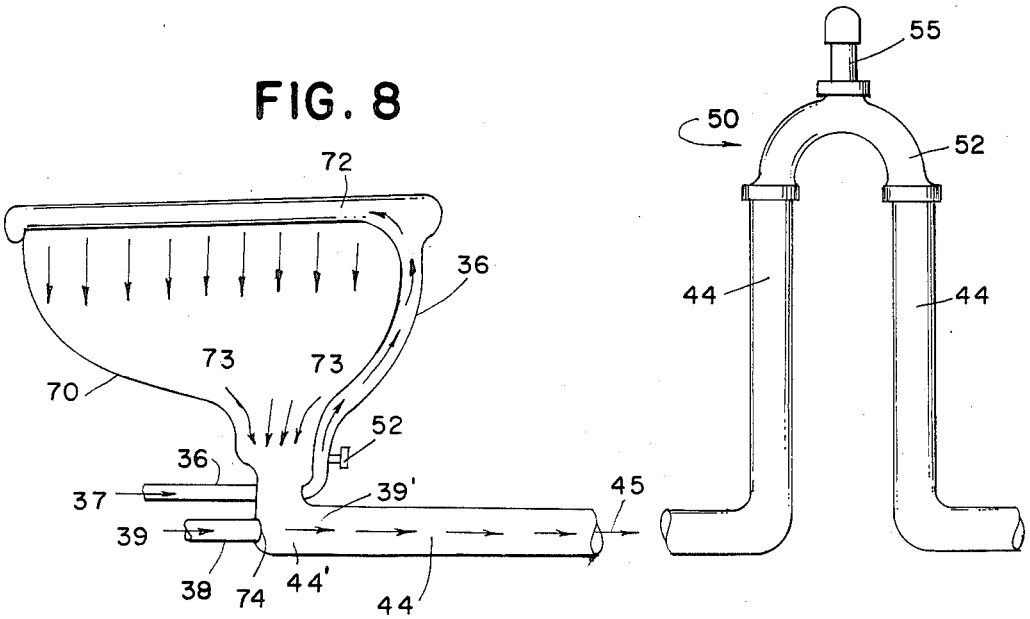

FIG. 3
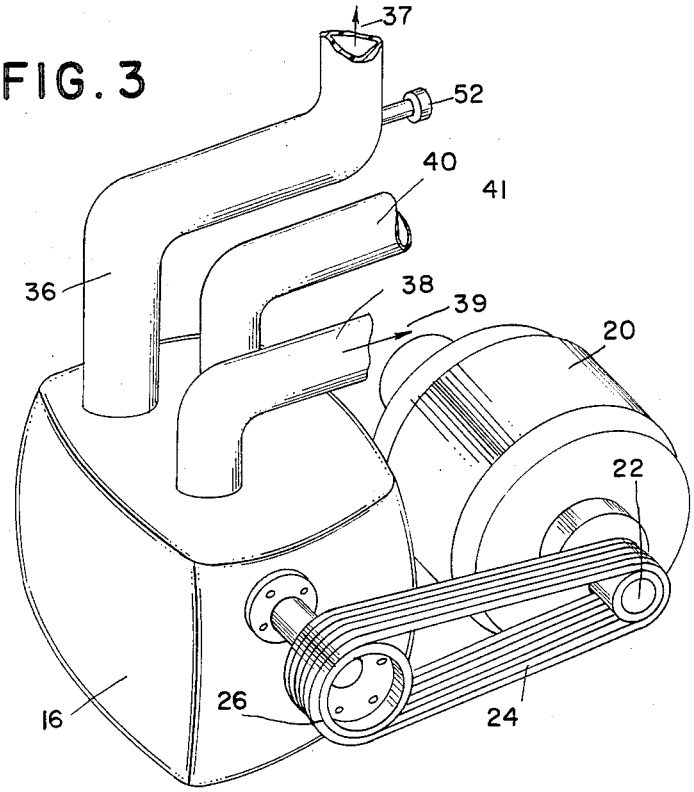
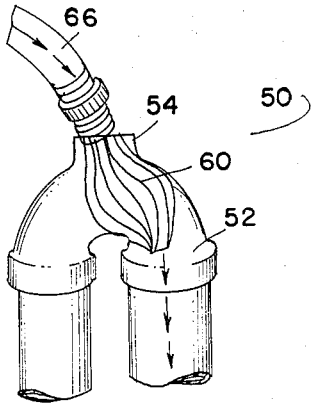
FIG. 4
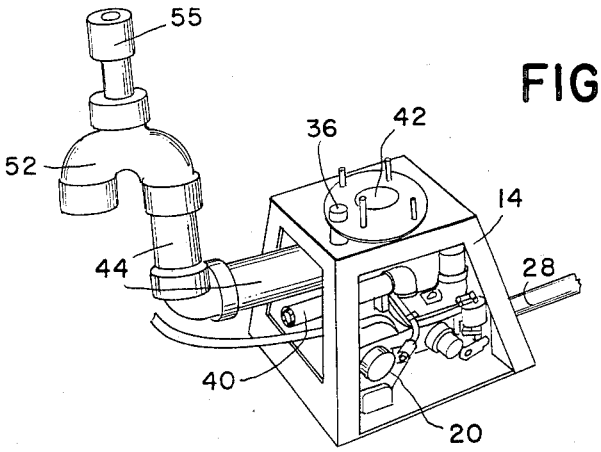
FIG. 5
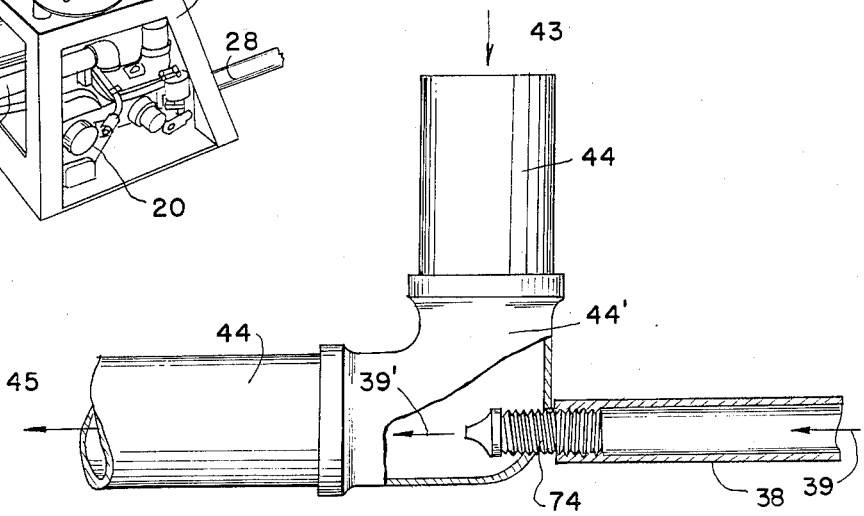
FIG. 6

WASTE DISPOSAL SYSTEM

BACKGROUND OF THE INVENTION

In the past, marine heads have been proposed with flushing features. None, however, have been provided with a nozzle-created high velocity flow through the bowl discharge conduit without having the bowl discharge material flow through pump cylinders, impellers, etc. Due to the absence of any of such obstructions, and the agitation caused by the turbulent flow material can flow through the bowl discharge conduit unfettered, thereby eliminating the possibility of clogging, even by paper or small metal objects.

SUMMARY OF THE INVENTION

This invention relates to a compact self-contained pedestal sized marine head comprised of a pedestal shaped base means for supporting a marine head or household sized toilet bowl and for housing therebelow an electric motor drivingly connected to a fluid pump. Said pump has a single suction water inlet and first and a second pump discharge outlets. The first pump discharge outlet is in fluid communication via a first pump discharge outlet conduit with an outlet means at the upper inside edge of the bowl to act as a rim feed. Valve means may be interposed to control the rim feed flow rate. An opening at the lowermost portion of the bowl acts as a bowl discharge opening and is fluidly and sealingly connected to a bowl discharge conduit. Said bowl discharge conduit passes waste material and rim feed water out of the bowl utilizing gravity, and therefore passes the bowl contents through a 90° elbow integrally incorporated with said bowl discharge conduit and disposed therein, said discharge conduit being in fluid communication with either a through-hull outlet port or an on-board holding tank.

Said second pump discharge outlet is in fluid communication via a second pump discharge outlet conduit with said 90° elbow by means of a nozzle interposed coaxially in said pump discharge outlet conduit at a junction of said pump discharge conduit with said 90° elbow.

Said nozzle discharges turbulent water at an elevated flow velocity towards the downstream direction of the bowl discharge conduit. Preferably, the flow stream issuing from said nozzle is essentially in a direction perpendicular to the flow due to gravity of the matter flowing within said bowl discharge conduit, which has passed from the bowl, before said matter reaches the 90° elbow. Said nozzle creates a venturi effect as water is accelerated along its axial direction. The acceleration of the fluid gives rise to a decrease in pressure in the nozzle itself and near the discharge of said nozzle causing a concomitant pressure drop within the fluid, as is commonly known. Matter flowing due to gravity through said bowl discharge conduit is drawn into the 90° elbow portion and directly into the stream of water issuing from said nozzle causing a vigorous interaction therein. In this way, the turbulent stream of water issuing from the nozzle exchanges in part its energy with the matter flowing from the bowl causing said matter to be agitated to such an extent that particulate matter are broken up and reduced in size ensuring unoccluded flow to a holding tank or through-hull discharge port. The energized stream of water issuing from the nozzle also acts to urge the bowl discharge matter toward its destination.

When flushing is required, the electric motor is energized by electrical connection to the ship's electric power system. In use, a foot or push button switch energizes a solenoid which in turn activates the motor, causing the pump to operate. Water from a storage tank or surrounding body of water is thereafter drawn into the pump's suction water inlet and discharged simultaneously through said first and second discharge outlets as previously described.

Downstream of said nozzle/elbow/bowl discharge conduit junction is interposed an inverted U-shaped conduit section which forms part of said bowl discharge conduit. The apex of said U-shape must be positioned above the water line of the vessel to prevent siphoning of seawater and subsequent sinking of the vessel. This is accomplished by associating a small one-way valve means atop said U-shaped portion for allowing a quantity of air to enter the bowl discharge conduit at the apex of the U-shaped portion thereby breaking the siphon.

Additionally, a small opening is provided at said apex on the order of size of $1\frac{1}{4}''$. Said opening allows access to the inside of said bowl discharge conduit to clear or remove blockages.

It is accordingly an object of the present invention to provide a self-contained marine head and flush pump assembly.

It is another object of the present invention to provide a flushable marine head unit which obviates the need to pass flushed material through pump impellers, piston cylinders, or the like.

It is a further object of the present invention to provide a self-contained marine head unit that can be installed in substantially less time than has heretofore been permitted.

In accordance with these and other objects which will become apparent hereinafter, the instant invention will now be described with particular reference to the accompanying drawings.

BRIEF DESCRIPTION OF THE DRAWINGS

FIG. 1 is a side view of the marine head assembly of the instant invention including the support base.

FIG. 2 is a front view of the marine head assembly of FIG. 1.

FIG. 3 is a perspective view of the motor and pump of the invention.

FIG. 4 is a partial view of the U-shaped anti-siphon illustrating its anti-clogging feature.

FIG. 5 is a perspective view of the invention of FIGS. 1 and 2 showing the bowl discharge conduit and the U-shaped anti-siphon.

FIG. 6 is a partial cutaway view of the jet nozzle/-bowl discharge conduit interconnector.

FIG. 7 is a top plan view of the pump.

FIG. 8 is an illustration of a bowl fixture with associated flushing conduits.

DESCRIPTION OF THE PREFERRED EMBODIMENT

Referring now to FIGS. 1, 2 and 8 showing a compact, self-contained pedestal sized marine head, generally designated by the reference numeral 10, comprised of a pedestal shaped base means 14 for supporting a marine or household size toilet bowl fixture 70 and for housing therebelow an electric motor 20 drivingly connected via motor pulley 22, belt 24 and pump pulley 26 to a fluid pump 16. Preferably pump 16 is a modified Groco P9000 self priming pump rated at 100 psi and 12 gpm. Said pump 16 has a single suction water inlet 17, a first pump discharge outlet 19 and a second pump discharge outlet 21. The first pump discharge outlet 17 is influid communication via a first pump discharge outlet conduit 36 with a rim discharge orifice 72 at the upper inside edge of the fixture to act as a rim feed, one embodiment of which is shown in FIG. 8. Valve means 52 may be interposed in said first conduit 36 to control the rim feed flow rate. An opening 42 at the lowermost portion of said fixture acts as a fixture discharge opening and is fluidly and sealingly connected to a fixture discharge conduit 44.

In operation, switch 28, as seen in FIGS. 2 and 5, connected to base 14, is made to energize solenoid 32 which in turn activates motor 20 in the customary manner. Motor 20 turns pump pulley 26 via motor pulley 22 and belt 24, causing a flow of water 41 to be drawn into pump 16 at suction inlet 17. Water is discharged simultaneously out of first pump discharge outlet 19 (flow 37) and second pump discharge outlet 21 (flow 39). Water issuing from orifice 72 causes flushing to occur within fixture 70, and flushed material, or effluent, 73 passes through opening 42. As seen in in FIGS. 3, 6 and 8, a second pump discharge outlet conduit 38 causes fluid communication between outlet 21 and a nozzle 74. Nozzle 74 is sealingly connected to conduit 38 and 90° elbow 44', as seen in FIG. 6. Water pumped from pump 16 through second pump discharge conduit 38 is accelerated through nozzle 74, emerges as stream 39', and mixes with effluent 73. Said nozzle 74 creates a venturi effect as water is accelerated along its axial direction. The acceleration of the fluid gives rise to a decrease in pressure in the nozzle itself and near the discharge of said nozzle causing a concomitant pressure drop within the fluid flow 39, as is commonly known. Matter flowing due to gravity conduit 44 is drawn into the 90° elbow portion 44' and directly into the energized stream of water 39' issuing from said nozzle causing a vigorous interaction therein. As a result of the elevated velocity of nozzle discharge stream 39', effluent 73 is urged through the remainder of the sanitation system of the invention and discharged to a typical sewage holding tank or through hull. In the preferred embodiment high velocity flow 39' issuing from nozzle 74 is aimed coaxially in the downstream direction of conduit 44. The elevated velocity also causes any breakable particulate matter in effluent 73 to be reduced in size, reducing the risk of blockage in conduit 44 and providing increased storage capacity of the waste material inasmuch as smaller sized particles occupy less volume then larger ones, weight being equal. The combined flow 45, comprised of nozzle dischage flow 39' and effluent 73, passes through the remainder of conduit 44. An inverted U-shaped section 50, as shown in FIGS. 4, 5 and 8, is interposed between conduit 44 and the holding tank or through hull. The function of said U-shaped section 50 is to act as an anti-syphon and also to retain a small amount of water in the bowl fixture 70 during periods of nonuse to act as an odor trap and to keep the inner bowl surface wetted for maintenance purposes. In many marine applications the head is below decks and often below the water line of the boat. Upon flushing, the conduits comprising the flushing system become filled with water and a reverse syphon process may occur whereby water flows into the boat through the head, flooding and sinking the boat. To counteract the reverse syphon effect, a small one-way valve 55 is connected atop section 50 which allows air in to break the syphon, but does not let air out. It should be noted that the apex of U-section 50 must be positioned above the water line of the boat.

A unique feature of the instant invention resides in the location of a small opening 54 of FIG. 4. Said opening is preferably in the range of 1–1¼" in diameter and is threadably sealable. In common operation, because flushed material must flow vertically upwards and then down again, as thorugh U-section 50, blockages can occur. The present invention discloses a simple means by which to clear such blockages. Valve 55 can be screwed off, revealing opening 54 at the apex of U-section 50. A device such as 60 can be connected to an ordinary hose 66 and inserted opening 54 to clear blockages even away from U-section 50. Article 60 is an elongated rubberlike flexible cylindrical member having one end to act as a threaded female member means for connecting article 60 to a hose 66, its other end being a discharge end. In use, article 60 is connected to a hose and passed through opening 54 to direct flow in either the downstream direction, as shown in FIG. 4, or the upstream direction. A pressurized flow of water is provided to article 60 causing its flexible casing to expand outwardly thereby blocking off conduit 52. Article 60 thereafter discharges a high velocity stream of pulsating bursts of water to remove the occlusion.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A waste disposal system, comprising:

a pedestal-like base;

a toilet bowl fixture connected to said base and having a lower discharge opening;

a discharge conduit sealingly connected to and depending from said lower discharge opening;

a first fluid pump means connected to said base for providing a first flow of fluid to the interior of said fixture;

first conduit means for carrying said first flow of fluid;

second fluid pump means connected to said base for providing a second flow of fluid to said discharge conduit;

pump suction inlet means for accepting a flow of incoming fluid;

second conduit means for carrying said second flow of fluid;

pump suction inlet means for accepting a flow of incoming fluid;

fluid flow acceleration means interposed at the juncture of said second conduit means with said discharge conduit for urging an effluent flow issuing from said discharge conduit toward a disposal point and for agitating said effluent flow to break up particulate matter within said flow.

2. A waste disposal system as recited in claim 1, wherein said fluid flow acceleration means is a nozzle.

3. A waste disposal system as recited in claim 1, wherein said fluid flow acceleration means is a nozzle disposed coaxially within said second conduit means, said nozzle being sealingly connected to both said discharge conduit and said second conduit means.

4. A waste disposal system as recited in claim 1, further comprising:

a motor connected to said base for driving engagement with said fluid pump means;

solenoid means connected to said base for energizing said motor by an outside source of electrical energy;

switch means connected to said base for electrically connecting said solenoid means with said outside source of electrical energy.

5. A waste disposal system as recited in claim 1, further comprising:

an anti-syphon means in the form of an inverted U-shaped conduit section sealingly connected to said discharge conduit at a point downstream of said nozzle/discharge conduit juncture, said U-shaped conduit having a one-way valve means connected to its apex for allowing air to enter said conduit section thereby breaking a siphon.

6. A waste disposal system as recited in claim 5, wherein said discharge conduit is comprised of (a) first vertically depending section, the upper end being in sealed engagement with the lowermost portion of said fixture, the lower end of said first vertically depending section being integrally connected to a right angle conduit section, and (b) a second horizontally extending section, one end being integrally connected with said right angle conduit section, the other end of said horizontally extending conduit section being integrally connected to said U-shaped conduit section.

7. A waste disposal system as recited in claim 6, wherein:

said nozzle is connected to said discharge conduit at said right angle conduit section and emits an elevated velocity flow of water in the axial direction with respect to said horizontally extending section.

8. A waste disposal system as recited in claim 5, wherein:

the waste disposal system is a marine head, the apex of said U-shaped section being positioned above the water line of the vessel in which said marine head is located.

9. A waste disposal system as recited in claim 8, further comprising a sealable opening at the apex of said U-shaped section to allow for the removal of occlusions upstream or downstream of said opening.

10. A waste disposal system as recited in claim 1, wherein said first and second fluid pump means comprise a single pump having one suction inlet and a first and second discharge outlets, said first discharge outlet being connected to said first conduit means, said second discharge outlet being connected to said second conduit means.

* * * * *